US011718985B2

(12) United States Patent
Walker

(10) Patent No.: US 11,718,985 B2
(45) Date of Patent: Aug. 8, 2023

(54) CONSTRUCTION BLOCK

(71) Applicant: Isaac Walker, La Pine, OR (US)

(72) Inventor: Isaac Walker, La Pine, OR (US)

( * ) Notice: Subject to any disclaimer, the term of this patent is extended or adjusted under 35 U.S.C. 154(b) by 0 days.

(21) Appl. No.: 17/501,864

(22) Filed: Oct. 14, 2021

(65) Prior Publication Data

US 2022/0112712 A1 Apr. 14, 2022

Related U.S. Application Data

(60) Provisional application No. 63/091,474, filed on Oct. 14, 2020.

(51) Int. Cl.

| | |
|---|---|
| ***E04B 2/30*** | (2006.01) |
| *E04B 2/00* | (2006.01) |
| *E04B 2/02* | (2006.01) |

(52) U.S. Cl.

CPC ..... *E04B 2/30* (2013.01); *E04B 2002/0247* (2013.01); *E04B 2002/0282* (2013.01); *E04B 2002/0297* (2013.01)

(58) Field of Classification Search

CPC ..... E04B 2/30; E04B 2002/0247; E04B 2002/0282; E04B 2002/0297; E04B 1/4178; E04B 1/4185; E04B 2/8635

USPC ..... 52/284, 379, 383

See application file for complete search history.

(56) References Cited

U.S. PATENT DOCUMENTS

| | | | | | |
|---|---|---|---|---|---|
| 840,071 | A * | 1/1907 | Lewis | E04B 2/30 | 52/505 |
| 1,052,788 | A * | 2/1913 | Bates | E04B 1/161 | 52/378 |
| 1,294,509 | A * | 2/1919 | Metzinger | E04B 2/30 | 52/563 |
| 1,420,478 | A * | 6/1922 | Forbush | E04B 2/34 | 52/426 |
| 1,543,509 | A * | 6/1925 | Nelson | E04B 2/40 | 52/438 |
| 1,732,056 | A * | 10/1929 | Lesher | E04F 13/16 | 52/489.2 |
| 1,784,329 | A * | 12/1930 | Bierhaalder | E04G 17/0754 | 249/19 |
| 1,923,645 | A * | 8/1933 | Thompson | E04B 2/30 | 52/431 |
| 2,261,510 | A * | 11/1941 | Atcheson | E04B 1/703 | 52/564 |

(Continued)

FOREIGN PATENT DOCUMENTS

| | | | | |
|---|---|---|---|---|
| DE | 4212975 A1 * | 10/1993 | A47F 5/105 | |
| GB | 288451 A * | 4/1928 | E04B 2/30 | |

(Continued)

*Primary Examiner* — Brian D Mattei
*Assistant Examiner* — Joseph J. Sadlon
(74) *Attorney, Agent, or Firm* — Donn K. Harms

(57) ABSTRACT

A mortarless block system for forming walls from blocks which are stackable in sequential rows upon each other. Upper rows of blocks positioned upon lower rows are securable by positioning of support rods through aligned passages thereof. The passages extend between upper and lower notches in each respective block. The support rods are engaged to connectors which are sized to fit completely within the notches to thereby leave the upper and lower surfaces of each lower row flush to stacking overhead rows thereon.

9 Claims, 10 Drawing Sheets

(56) References Cited

U.S. PATENT DOCUMENTS 2,535,494 A * 12/1950 Kingsmill ..... E04B 1/08 52/582.2
2,658,379 A * 11/1953 Allen ..... E04C 2/041 52/289
2,715,829 A * 8/1955 Kleeberg ..... E04B 2/30 52/563
2,892,338 A * 6/1959 Cravens ..... E04B 2/42 52/566
2,942,115 A * 6/1960 O'Connell ..... G21F 3/04 250/517.1
3,238,684 A * 3/1966 Wood ..... E04G 21/12 52/712
3,571,999 A * 3/1971 Downing ..... A47F 11/02 40/605
3,686,873 A * 8/1972 Vidal ..... E02D 29/0241 405/262
3,759,003 A * 9/1973 Wilson ..... E04B 2/12 52/285.4
3,780,484 A * 12/1973 Muse ..... E04B 2/14 52/568
4,038,798 A * 8/1977 Sachs ..... B28B 19/0038 52/441
4,129,163 A * 12/1978 Johnson ..... E04B 2/7427 52/239
4,418,884 A * 12/1983 Schimmel ..... E04G 11/02 249/11
4,532,745 A * 8/1985 Kinard ..... E04B 2/8629 52/439
4,574,550 A * 3/1986 Maschhoff ..... E04B 2/40 52/309.12
4,655,014 A * 4/1987 Krecke ..... E04B 2/8641 52/426
4,660,342 A * 4/1987 Salisbury ..... E04B 2/8629 52/358
4,731,968 A * 3/1988 Obino ..... E04C 1/39 52/564
4,884,382 A * 12/1989 Horobin ..... E04B 2/8641 52/564
4,894,969 A * 1/1990 Horobin ..... E04C 1/40 52/564
4,901,494 A * 2/1990 Miller ..... E04B 2/8647 52/562
5,086,600 A * 2/1992 Holland ..... E04C 2/205 52/564
5,291,711 A * 3/1994 Kopaz ..... E04B 2/40 52/564
5,746,035 A * 5/1998 Seiber ..... E06B 3/5045 52/238.1
5,809,727 A * 9/1998 Mensen ..... E04C 1/40 52/426
5,890,337 A * 4/1999 Boeshart ..... E04B 2/8652 52/432
6,098,357 A * 8/2000 Franklin ..... E04B 2/52 52/439
6,230,462 B1 * 5/2001 Beliveau ..... E04B 2/8617 52/592.6
6,318,040 B1 * 11/2001 Moore, Jr. ..... E04B 5/32 52/379
6,336,301 B1 * 1/2002 Moore, Jr. ..... E04B 2/8635 52/426
6,493,995 B2 * 12/2002 McKenzie ..... A47F 5/105 52/239
6,609,336 B2 * 8/2003 Matsubara ..... E04C 3/28 52/234
6,978,581 B1 * 12/2005 Spakousky ..... E04B 2/8617 52/424
7,055,289 B2 * 6/2006 Guth ..... E04B 1/2612 52/327
8,037,652 B2 * 10/2011 Marshall ..... E04B 2/8635 52/564
8,297,021 B2 * 10/2012 Quinones ..... E04C 3/28 52/234
8,555,588 B2 * 10/2013 Stokes ..... E04F 13/16 52/489.2
8,590,215 B2 * 11/2013 Damichey ..... E04G 11/02 249/11
8,656,678 B2 * 2/2014 MacDonald ..... E04G 17/0754 249/19
8,752,349 B2 * 6/2014 Westaby ..... E04G 21/12 52/712
8,826,601 B2 * 9/2014 Gyory ..... E06B 3/5045 52/238.1
8,881,483 B2 * 11/2014 Caboni ..... G21F 3/04 250/517.1
8,887,465 B2 * 11/2014 Crosby ..... E04B 2/8641 52/564
8,898,990 B2 * 12/2014 Drew ..... E04B 1/40 52/600
9,302,709 B1 * 4/2016 Kumar ..... E04B 2/14 52/568
9,340,972 B2 * 5/2016 Naidoo ..... B32B 13/02
9,476,200 B2 * 10/2016 Gomes ..... E04B 1/161 52/378
9,593,480 B2 * 3/2017 Vandenbempt ..... E04B 2/12 52/285.4
10,415,241 B2 * 9/2019 Simonson ..... E04C 5/01
2007/0079566 A1 * 4/2007 Neill ..... E04B 2/46 52/425
2009/0126280 A1 * 5/2009 Radi ..... E04B 2/02 52/168
2009/0311038 A1 * 12/2009 Lavi ..... A47B 47/05 403/24
2012/0079783 A1 * 4/2012 Nylin ..... E04B 2/8629 52/309.1

FOREIGN PATENT DOCUMENTS

GB 1228579 A * 4/1971 ..... E04B 2/06
WO WO-2017035674 A1 * 3/2017 ..... E04C 2/26

* cited by examiner

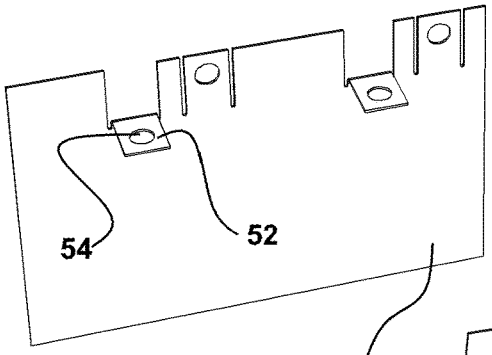
FIG. 21
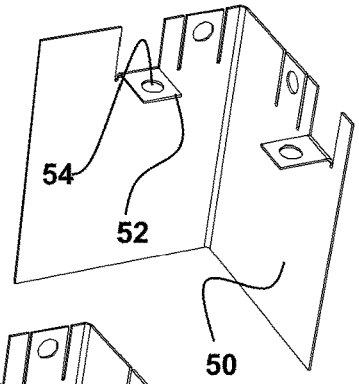
FIG. 22
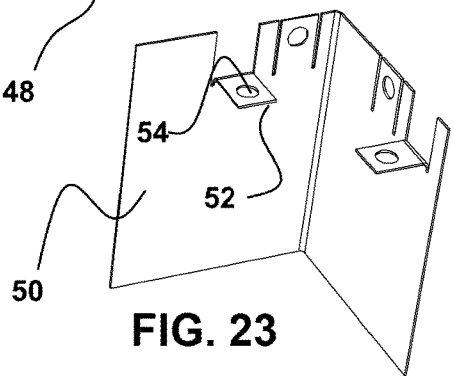
FIG. 23
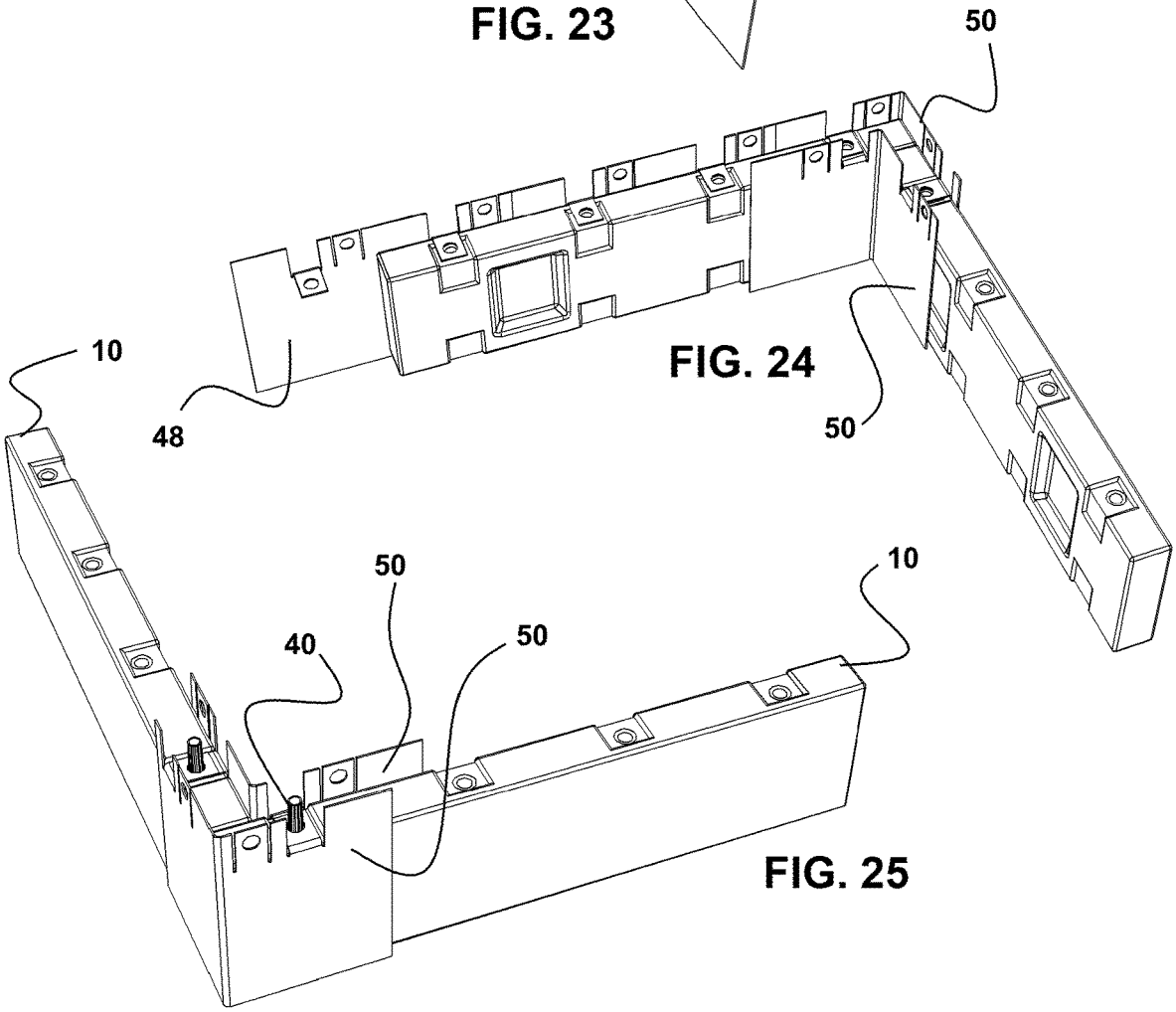
FIG. 24
FIG. 25

CONSTRUCTION BLOCK

This application claims priority to U.S. Provisional patent application Ser. No. 63/091,474 filed on Oct. 14, 2020, which is incorporated herein in its entirety by this reference thereto.

FIELD OF THE INVENTION

The disclosed device generally concerns blocks which are employable for construction. More particularly, it relates to a block, which is configurable from synthetic, polymeric, or cementitious material,s which is configured for forming buildings, walls, and other modular assembled structures using a number of differing formations of the block which are available.

BACKGROUND OF THE INVENTION

Conventional concrete block walls are laid up by a time-consuming difficult procedure which involves troweling a layer of concrete mortar onto a level concrete or stone base or the like, or the top of a course of previously laid blocks and then setting blocks one at a time in the mortar layer, in each instance also applying mortar to the end walls of each block to join the blocks together. This procedure is continued until the required number of courses are laid. Great care must be taken to keep each course perfectly horizontal and straight. Few people have the skill to carry out such a procedure in a competent manner. Therefore, the cost of such construction is always high.

Various types of interlocking blocks have been devised in the past to facilitate block laying without mortar. However, most such blocks are very heavy, and are very expensive to produce and to ship to job sites, especially those which are in remote locations.

The forgoing concerning mortarless blocks and similar art, and issues regarding such, are intended to be illustrative and not exclusive and they do not imply any limitations on the invention described and claimed herein. Various other limitations of the related art are known or will become apparent to those skilled in the art upon a reading and understanding of the specification below and the accompanying drawings.

SUMMARY OF THE INVENTION

As noted, conventional concrete and other block walls employed in wall and other construction are laid up by a time-consuming difficult system that involves concrete mortar being placed onto the footing or the top of a course of previously laid blocks. This time consuming placement of mortar and subsequent setting of blocks is time consuming and expensive since it requires skilled placement of blocks one at a time in the mortar. In each instance the mason applies mortar to the end wall of the block to join them together end to end.

This block positioning procedure is continued until the desired wall or other structure is fully formed and in place. Great care must be taken to keep each block and row thereof perfectly horizontal and straight and the spacing between blocks even. Thereafter, conventionally, additional time is required in the finishing of the mortar joints on both sides of the wall surfaces. Such a system employs very heavy blocks, and it generally takes a skilled block mason with years of experience to lay block and engage the blocks properly with even spacing end to end.

With the employment of such heavy blocks, the freight costs can be very high, especially where the job site is outside of a city or in the wilderness. Further, such block and mortar systems are outside the skill set of most non professionals, and thus homeowners and individuals wishing to construct walls and buildings themselves, are unable to do so. As a consequence, job sites which employ block and mortar systems require a great deal of skilled laborers along with high transportation costs, which keeps the cost of this type of construction high.

The block system herein provides a block formed of a body having an exterior surface which includes a plurality of recessed areas or notches which are formed into a top surface and a bottom surface of the body forming the block. Preferably, in all modes the top and bottom surface notches or recesses intersect with secondary recesses or notches which are formed into a first side surface of the blocks. These notches or recesses provide areas for positioning of any one of a kit of connector brackets having connectors which fit into the notches in the blocks, which provide for secure stacked engagement of rows of the blocks in stacks for walls and the like.

The blocks can also include recesses formed into at least a first side of the block which have been shown to significantly reduce weight and freight costs without a significant loss of strength. When the body of the blocks are formed to surround an interior cavity of each block, these recesses have been found, in experimentation, to provide for a stronger sidewall to the body of the blocks.

In all modes of the system herein, top and bottom surface notches are aligned on each block and allow for positioning of structural members and connectors therein, from a kit of such connectors. The shape of brackets included in the connectors conforms to the shape of the adjacent top and side notches to allow for level positioning of sequential stacked rows of blocks to form walls.

In all modes of the device the top surface notches or recesses are aligned positions with the notches or recesses formed into the bottom surfaces. Passages are formed into the interior of the blocks which communicate into the top surface notches and bottom surface notches. These passages, as noted herein, are configured for positioning of support members therein. These support members once operatively positioned, extend through aligned passages of each block positioned in each row of stacked blocks. The support members, in an especially preferred mode of the device, taper from a thicker area at the top and bottom edges of each block to a thinner cross section area at connectors at distal ends of the connector which engage within the interior of the blocks. The passages, in which the support members engage, are tapered in the same fashion and have a cross section along their length matching the cross section of the support members. This taper has been found to make it easier for a user to align each row of blocks with adjacent rows.

As shown herein, the support members can be engaged to a number of different connector brackets which are configured with connectors, in shape, to match the recesses formed into the top and side surfaces of the blocks. With a mount positioned in a recess, and the engaged support member positioned within the passage in a block, the formed wall has both vertical and shear support to resist movement. While the support members herein are shown in operative engagement with a number of differently configured mounts which are positioned within the top, bottom and side notches in the blocks, such should not be considered limiting. Any mount engaged to a support member sized to engage within a passage of the blocks herein, as would occur to one skilled in the art, is considered within the scope of this invention.

With respect to the above description, before explaining at least one preferred embodiment of the mortarless block device and method herein in detail, it is to be understood that the invention is not limited in its application to the details of construction and to the arrangement of the components in the following description or illustrated in the drawings. The invention herein described and shown is capable of other embodiments and of being practiced and carried out in various other ways by those skilled in the art upon reading this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other multi-configurable blocks which engage without mortar, and for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising." Thus, use of the term "comprising" indicates that the listed elements are required or mandatory, but that other elements are optional and may or may not be present. By "consisting of" is meant including, and limited to, whatever follows the phrase "consisting of." Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. The term "substantially" when employed herein, means plus or minus ten percent unless otherwise designated in a different range.

It is an object of the present invention to provide a mortarless block and building method employing such, which is employable by both professionals as well as homeowners and do it yourself builders.

It is a further object to provide such a block system which can be formed either entirely in a mold or formed as an exterior casing which may be filled on site to reduce shipping costs.

It is a further object of this invention to provide such a mortarless block system where the blocks can be easily engaged to form wall structures.

It is a further object of this invention to provide a system of support members engaged with bases which are positionable in recesses in the blocks to allow for walls to be formed, which can be vertically tensioned and has enhanced shear strength.

These and other objects, features, and advantages of the present mortarless block device and the method block formation and construction therewith, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed mortarless block configuration and construction method herein. It is intended that the embodiments and figures disclosed herein are to be considered illustrative of the invention herein, rather than limiting in any fashion.

In the drawings:

FIGS. 21-23 depict side and inner and outer corner brackets of the system herein which are engageable with projecting taps adapted for recessed positioning within the notches.

FIGS. 24-25 show examples of a wall portion having the brackets of FIGS. 21-23.

DETAILED DESCRIPTION OF THE INVENTION

Figure 1:
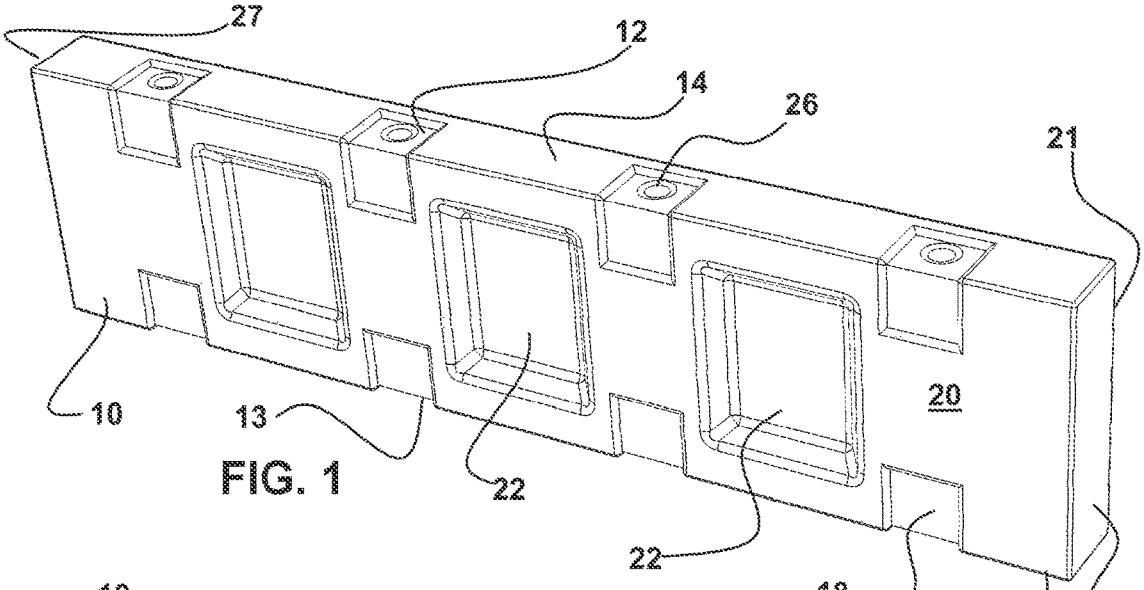
FIG. 1 depicts a perspective view of a block formed pursuant to the system and method herein and showing multiple connection areas for adjacent underlying and overlain blocks.

In this description, the directional prepositions of up, upwardly, down, downwardly, front, back, top, upper, bottom, lower, left, right, first, second, and other such terms refer to the device as it is oriented and as it appears in the drawings, and all such terms are used for convenience only and such are not intended to be limiting or to imply that the device has to be used or positioned in any particular orientation.

Now referring to drawings in FIGS. 1-27, wherein similar components are identified by like reference numerals, there is seen in FIG. 1, a perspective view of a block 10 formed pursuant to the system and method herein. As shown, the block 10 is formed of a body having an exterior surface which includes a plurality of upper notches 12 which are formed into a top surface 14 and a plurality of aligned lower notches 13 formed into the bottom surface 16 of the body of the block 10. These upper notches 12 and lower notches 13 may intersect with vertical secondary notches 18 which are formed into a first side 20 of the body of the block 10.

Also shown are a plurality of recesses 22 which depend into the first side 20 of the body of the block 10. These recesses 22 have been shown, in experimentation, to reduce the weight of the block 10 when formed in a unitary structure with the interior formed of the same material as the exterior of the body of the block 10 when the body of the block 10 is formed with an exterior surface which surrounds an interior cavity 24 as in FIGS. 4-6. The recesses 22 have been found in experimentation to provide for a stronger sidewall of the body of the block 10 where the exterior surface surrounds and defines the interior cavity 24.

By exterior surface is meant top surface 14 and the bottom surface 16, which connect between the first side 20 and an opposite second side 21 of a block 10 and between a first endwall 25 and between a second endwall 27, such as in FIG. 1. The exterior surface can be formed to hold the shape of the block 10 in modes which are formed hollow for inexpensive shipping. In this hollow mode, this exterior surface of the block 10 device herein, can be formed by molding to form a skin or exterior surface which can later be filled with cementacius or other material. Such may be by injection molding or polymeric or cementacius or other materials which can later be filled. In solid modes of the block 10, it would be formed as conventional solid core cementitious blocks such as cinder blocks.

Figure 2:
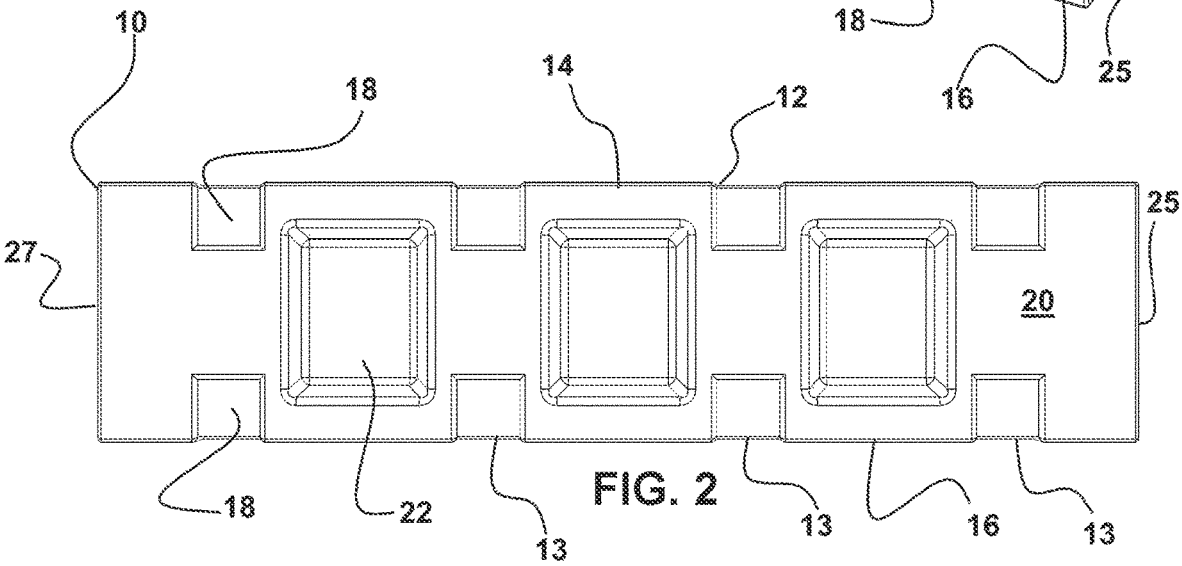
FIG. 2 depicts a frontal view of the block of FIG. 1 and shows notches formed for both structural attachments as well as recesses for stiffening the sidewall of the formed block.

Shown in FIG. 2 is a view of the first side 20 of the block 10 herein positioned opposite a second side 21. As shown, the secondary notches 18 are positioned to intersect the upper notches 12 forming recesses into the top surface 14 and aligned lower notches 13 formed into recesses in the bottom surface 16. This intersection is substantially perpendicular. A plurality of the recesses 22 are shown formed into the first side 20 of the exterior surface of the body of the block 10 and could be formed into the second surface 21. Although, currently, a smooth flat second surface 21 is preferred.

The upper notches 12 and lower notches 13 and the intersecting secondary notches 18 if included, are configured to allow for positioning of structural support members 28 and any required nuts or fasteners therein, such as in FIGS. 7 and 8, whereby the support members 28 are positioned below the top surface 14 so as to allow for level positioning of additional rows of blocks 10 thereon.

Figure 3:
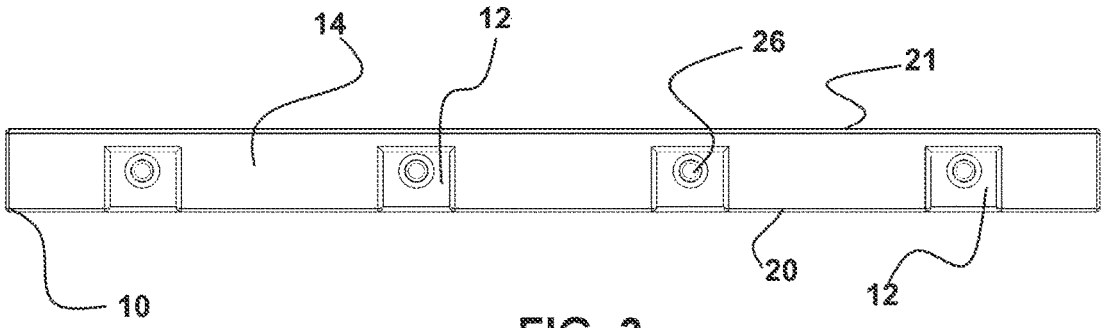
FIG. 3 depicts a top view of the block of FIGS. 1-2, where the bottom view would be a mirror image and shows a plurality of passages communicating through the block, which are positioned within respective notches formed on the top side surface and bottom side surface of the block.

In FIG. 3 is shown a top view of the body of the block 10 of FIGS. 1-2 and showing the plurality of upper notches 12 formed into the top surface 14, each defining a recessed area. As noted, preferably aligned lower notches 13 are preferably also formed into the bottom surface 16 of the block 10, each in aligned positions with those in the top surface 14.

Figure 12:
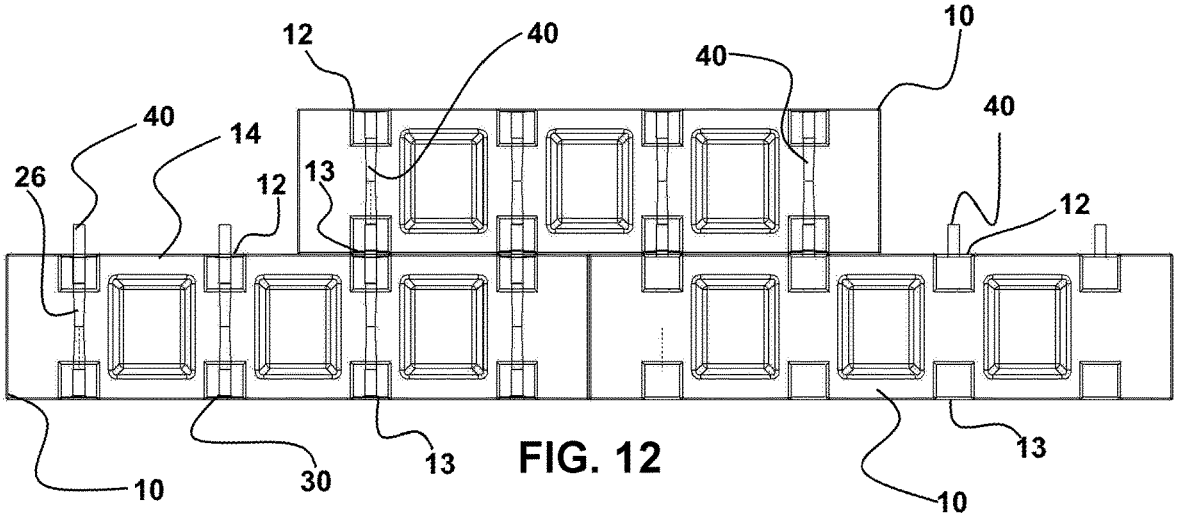
FIG. 12 shows an example of a plurality of the blocks herein, in a stacked engagement with support rods operatively engaged therethrough.
Figure 13:
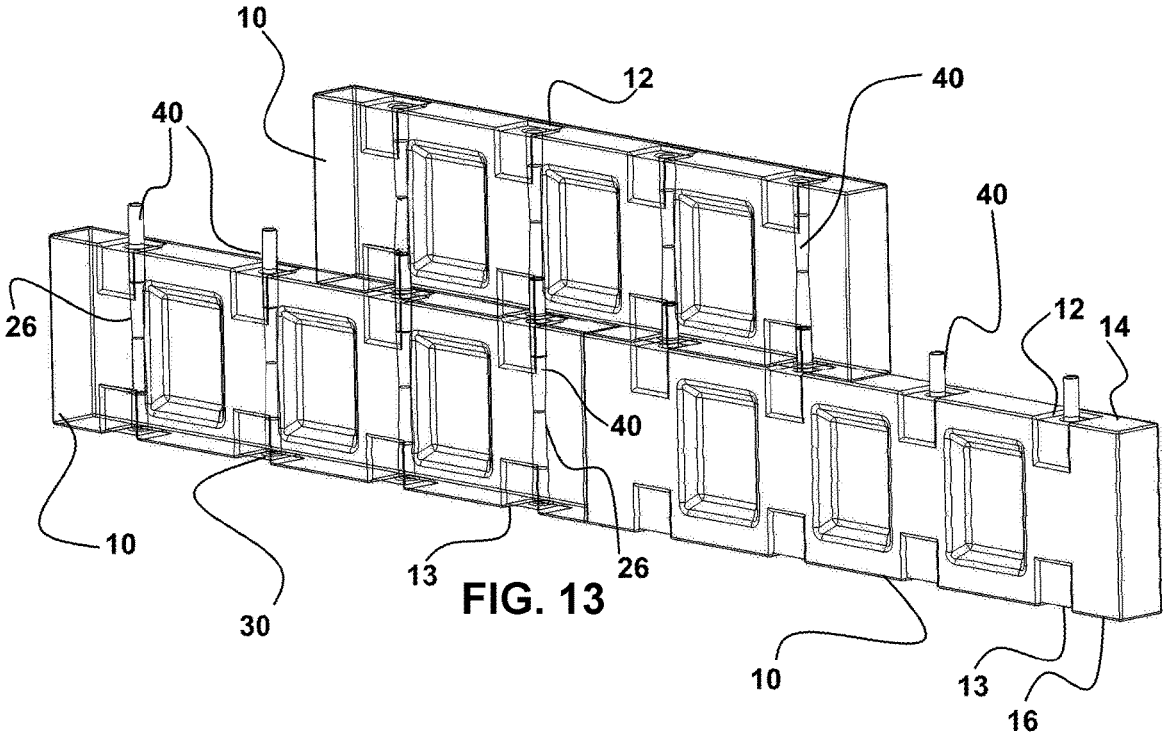
FIG. 13 is a perspective view of the formed wall of FIG. 12 showing the stacking of the blocks which are engaged with support rods connected between adjacent stacked blocks.
Figure 14:
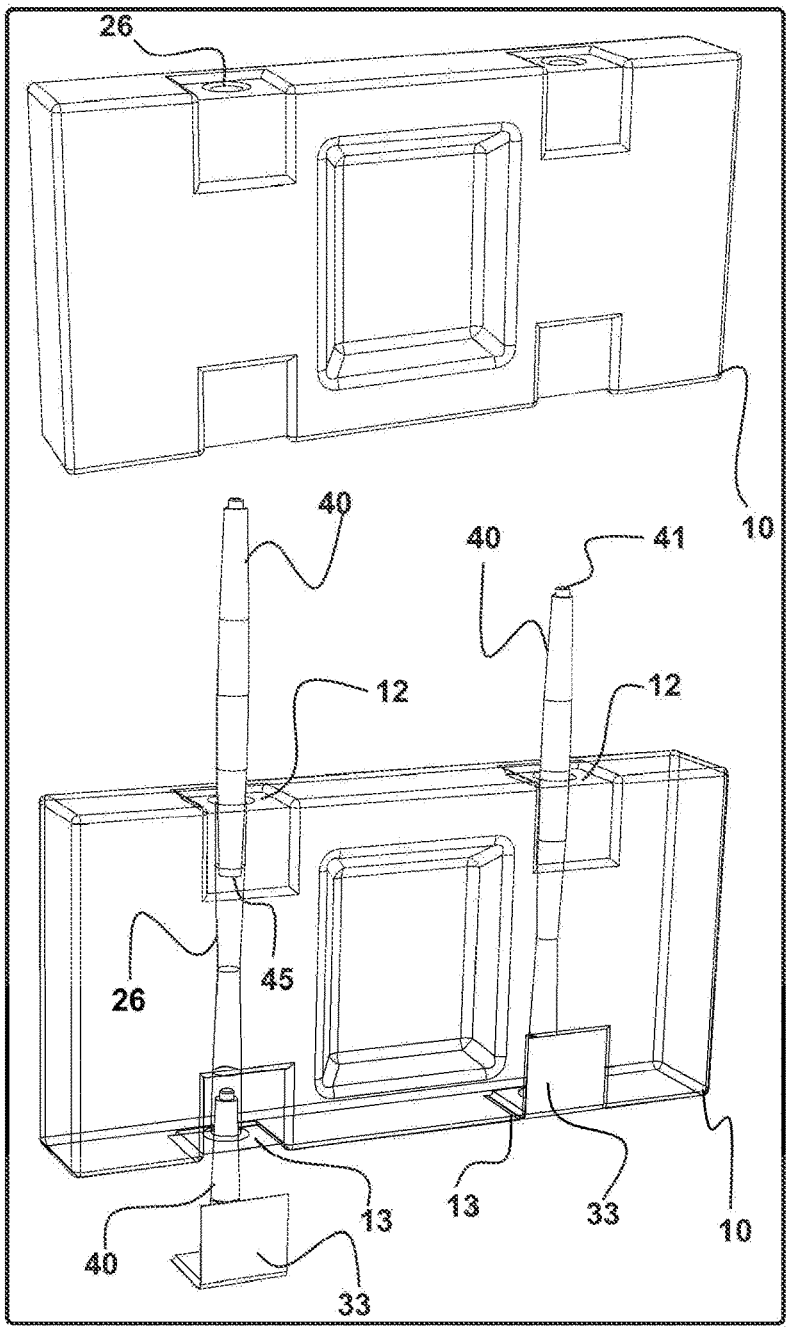
FIG. 14 shows the positioning of an overhead block upon an underlying block to form a stacked configuration and also shows L-shaped connectors engaged with the support rods.

Also shown are a plurality of passages 26 which communicate through the body of the block 10 from the top surface 14 to the bottom surface 16. These passages 26, as noted below, are configured for positioning of support members 28 therein. The support members 28 will extend through aligned passages 26 of each row of stacked blocks 10 and may have planar connector brackets such as connectors 30 (FIG. 7) or angled or L-shaped connector brackets 33 (FIG. 14 engaged and tightened on both ends of the support members 28, to impart a compressive force to the stacked blocks 10 in formed wall structures such as shown in FIGS. 8, and 12-13. As shown in FIG. 7 or FIG. 14 the connectors 30 or connector brackets 33 are preferably sized for positioning entirely within an upper notch 12 or lower notch 13 such that it does not project above the adjacent top surface 14 or bottom surface 16 of the block 10.

Figure 4:
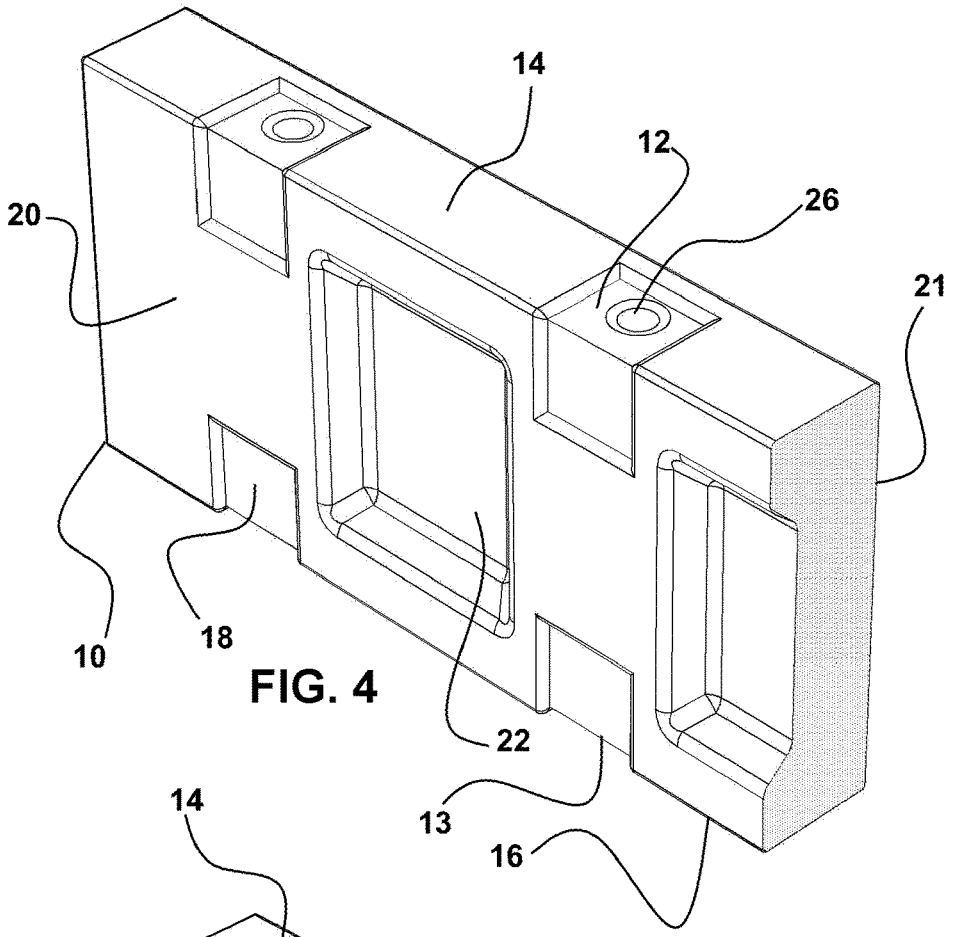
FIG. 4 shows a block of the system herein, which is formed in a unitary structure within the block and on the surfaces of the block.

In FIG. 4 is depicted a unitary structure form of the block 10 herein. As shown, the interior area of the block as well as the exterior surface, are formed of a single material, such as a cementitious material or a polymeric material.

Figure 5:
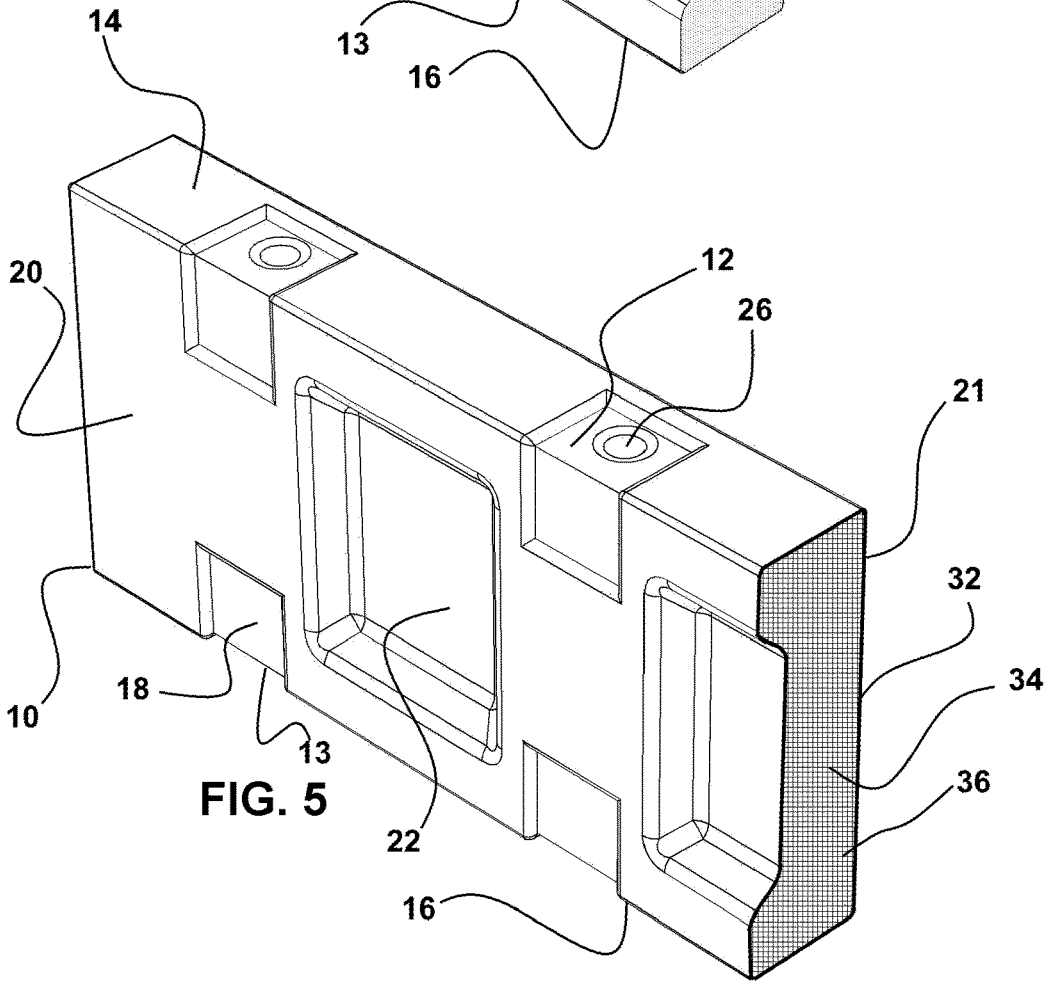
FIG. 5 depicts a mode of the block herein, wherein the block is formed in a body having a sidewall having an exterior surface and defining an interior cavity which is filled with corrugated or other fill material, thereby significantly reducing weight and shipping costs.

Depicted in FIG. 5 is a mode of the block 10 herein, wherein the block 10 has a body where the top surface 14 bottom surface 16, first side 20 and second side 21, are formed by a sidewall 32. This sidewall 32 defines an interior cavity 34. This interior cavity 34 may be filled with a different material from that forming the body defined by the sidewall 32. In this mode of the block 10, the weight is significantly reduced by the formation of the hollow interior cavity 34 making it easier to carry and less expensive to ship.

As shown in FIG. 5, the interior cavity 34 is filled with a corrugated material 36 which provides strength to the formed block 10. Where the fill material within the interior cavity 34 is not a liquid or powder, it may be positioned within the interior cavity 34 during molding of the body of the block 10, such as by co-molding.

Figure 6:
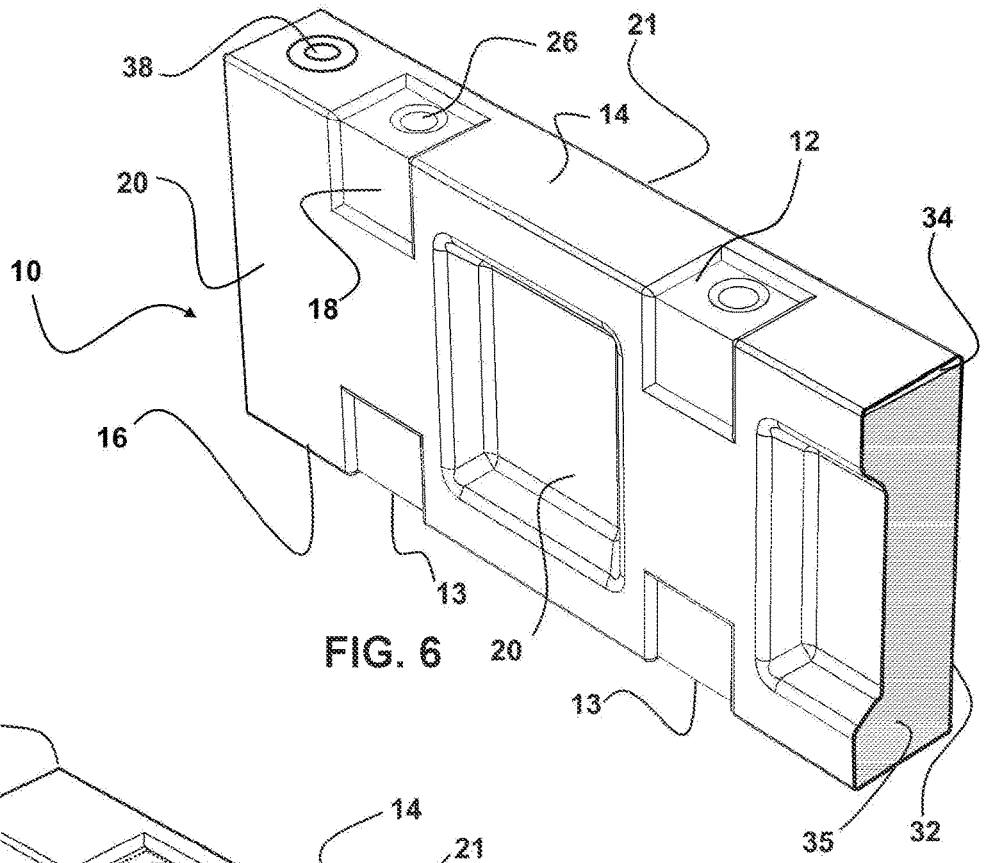
FIG. 6 shows a mode of the block herein, similar to that of FIG. 5, wherein the body of the block is formed a sidewall defining an interior cavity, which may be filled on site through a fill aperture.

In FIG. 6 is depicted a mode of the block 10 herein, similar to that of FIG. 5, but where the body of the block 10 as defined by the sidewall 32 defines an interior cavity 34, which may be filled on the construction site through a fill aperture 38 which is sealable and communicates with the interior cavity 34. In this mode, the fill material might be any liquid 35, such as a gel, or flowing material which solidifies when mixed with water or another liquid which may be poured though the fill aperture 38. This mode of the block 10 is especially lightweight and can be easily and cheaply shipped. In this mode the passages 26 are formed by the sidewall 32 which surrounds them, and thus they are sealed from the material which is placed within the interior cavity 34. The body of the block 10 in this mode may be formed by molding of the material forming the sidewall 32, such as a polymeric material which is UV inhibited and has a long lifespan such as polypropylene, polyethylene, or another polymeric material as would occur to those skilled in the art.

Figure 7:
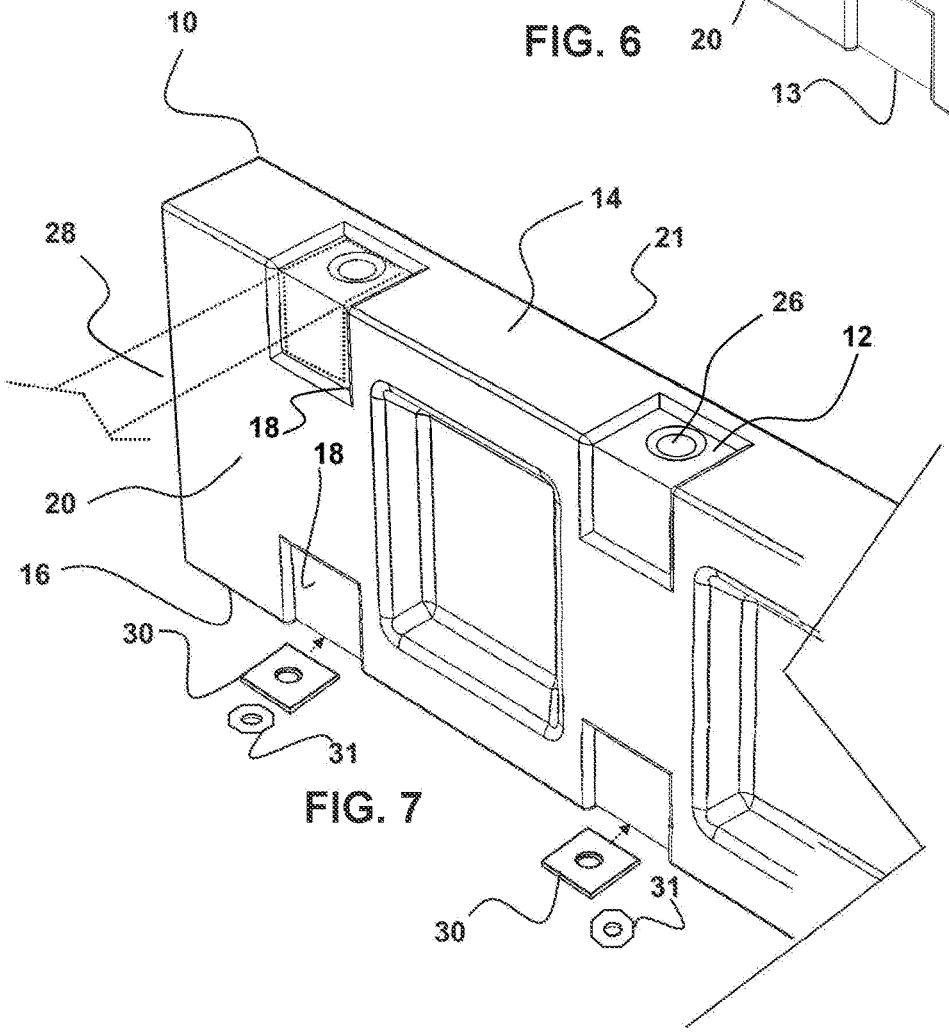
FIG. 7 shows the block herein of FIGS. 1-6, and depicts the notches formed into the top and recesses in the sidewall of the exterior of the block, which are configured for positioning of support structures for roofs and the like, as well as connectors which are configured to engage with support rods shown in FIGS. 8-10 to allow for compression.

Shown in FIG. 7 is a block 10 herein, such as those of FIGS. 1-6. Connectors 30 of the system herein are shown, which are configured to engage with or have support rods 40 engaged thereto as in FIGS. 16-19 for example. Each support rod 40 is sized for sliding engagement within and through the passages 26 of the blocks 10 such as when positioned to form structures as in FIGS. 12-13. As noted, the support rods 40 are preferably formed to taper from a larger cross section adjacent the connectors 30 to a narrower cross section at distal ends thereof. This taper allows for easier positioning of the blocks 10 onto the support rods 40. The hollow passages 26 communicating between the top surface 14 and bottom surface 16 of the blocks 10 preferably have a shape and cross section which matches the shape and cross section of the support member 28 inserted therein to achieve contact therebetween across the length of the passages 26.

These connectors 30, as shown in FIGS. 7 and 15-19, are sized for a recessed positioning with the upper notches 12 and lower notches 13 which surround the openings into passages 26 through which the support rods 40 communicate. A tightening of the engagement between the connectors 30 and the support rods 40 at opposing ends thereof, will impart a compressive force to the stacked rows of blocks 10 to enhance stability. This can be achieved by fasteners such as nuts 31 which engage with a threaded end 41 of a support rod 40 projecting through a planar connector 30 or threaded aperture therein.

Figure 15:
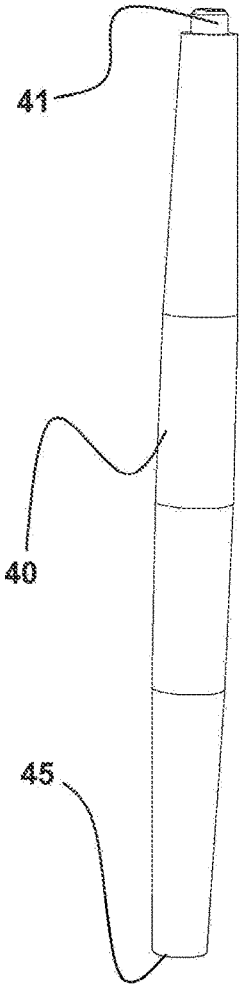
FIG. 15 depicts an example of a support rod which can be positioned as in FIG. 14 to have a tapered portion thereof projecting above the top surface of a lower positioned block.
Figure 16:
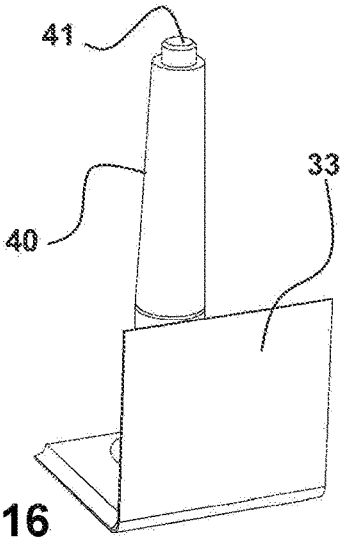
FIG. 16 depicts a connector bracket herein where the support rod is engaged to the connector which is L-shaped.
Figure 17:
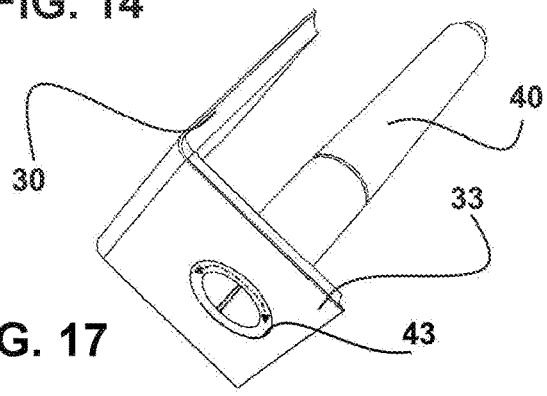
FIG. 17 shows a connector bracket having an L-shape in which the support rod is rotationally engaged in a permanent engagement whereby the support rod can be rotated to achieve a connection to a nut, bracket or other support rod.

Alternatively, where the connectors 30 are formed as L-shaped connector brackets 33, as in FIGS. 16-19, a rotating engagement of the support rods 40 with the connector bracket 33 as in FIG. 17 will provide the ability to impart compression to the wall formed. As shown in FIG. 17, for example, the support rod 40 is in a rotating connection 43 with the connector bracket 33 and can be rotated therein, to tighten the threaded end 41 into and with the threaded recess 45 of the distal end of another support rod 40. The L-shaped connectors or connector brackets 33 of FIGS. 16-17 can have either a threaded end 41 or threaded recess 45 (FIG. 15) therein.

Shown in FIG. 7 is an example of the system herein, wherein two walls are formed by blocks 10 allowing for positioning of soil or insulation therebetween. In this mode a support member 28, which like the connectors 30, is dimensioned to fit into the upper notches 12 and lower notches 13 and be recessed below the top surface 14 or bottom surface 16 to make those surfaces level. Such support members 28 may be employed to hold a roof elevated, for example, or when two rows of blocks 10 are engaged by such support members 28 as in FIG. 8 or 8A, or in other construction as would occur to those skilled in the art.

Figure 8:
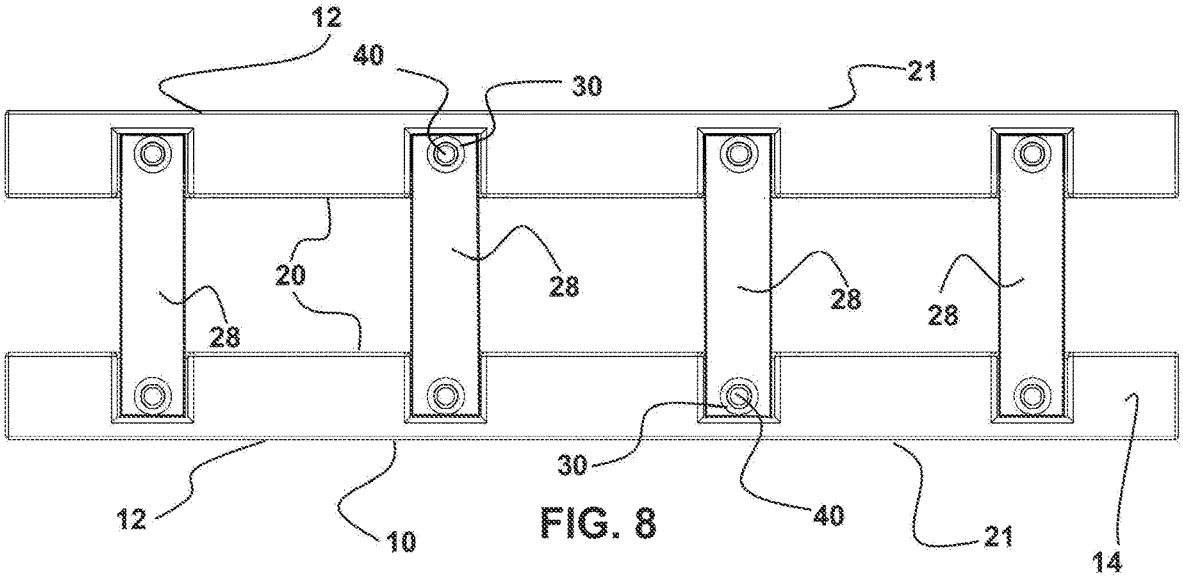
FIG. 8 depicts an overhead view of the blocks herein formed to two adjacent parallel walls and having support members engaged therebetween across a formed gap between the two walls.
Figure 8A:
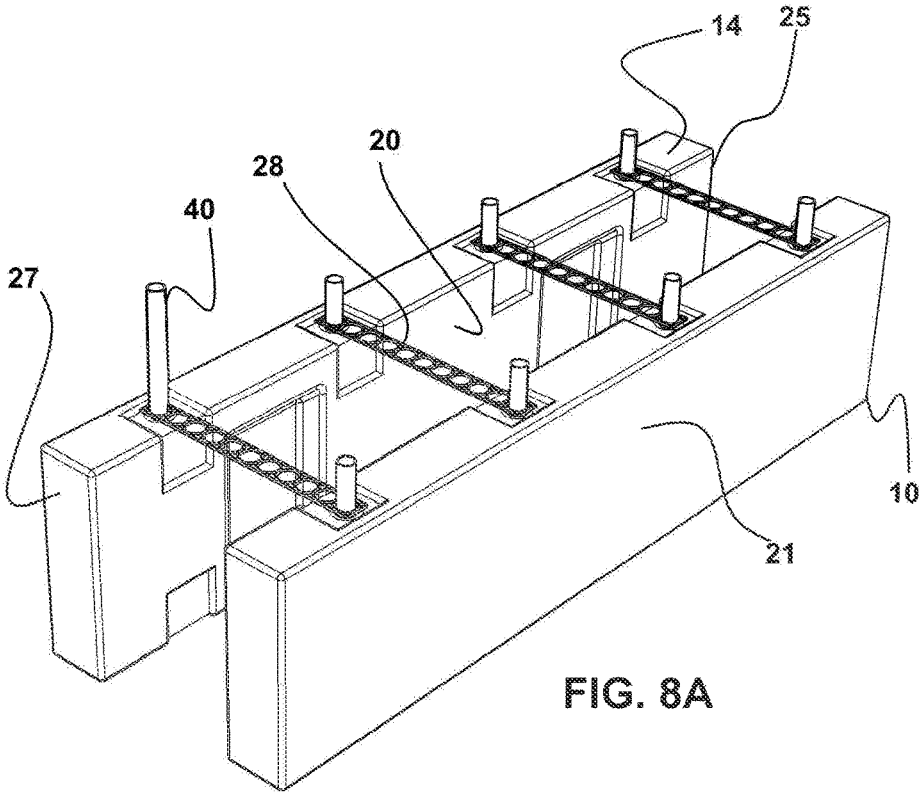
FIG. 8A depicts a perspective view of the blocks herein formed to two adjacent parallel walls and having support members engaged therebetween across a formed gap between the two walls.

Shown in FIGS. 8 and 8A are overhead views of this mode of the block system herein, wherein the blocks 10 are stacked in layers and rows to form two adjacent parallel walls. This configuration is especially well adapted to enhance stability of a structure and to allow for positioning of insulation or other material in between the two walls. As shown, support members 28 are dimensioned for recessed engagements into respective notches 12 or 13 and are engaged between the two walls formed of blocks 10. Support rods 40 are communicated through openings in each connector 28 to hold both the support rods 40 and to compress the blocks 10 and to hold the support members 28 in place.

Figure 9:
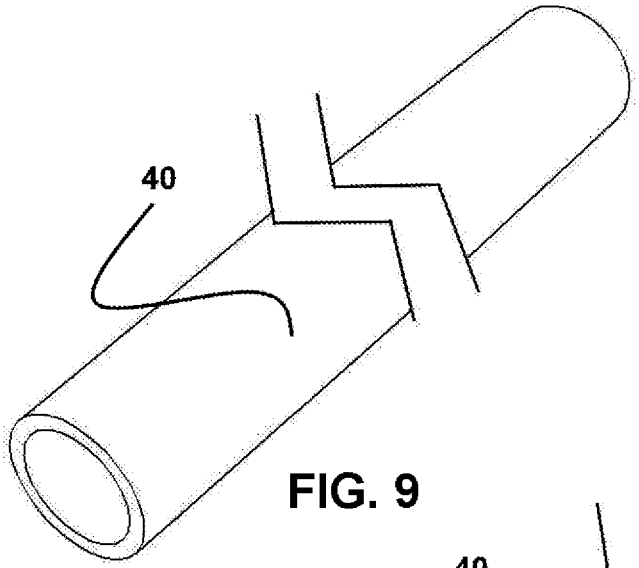
FIGS. 9-11 depict various configurations of support rods which are employed through the aligned passages in stacked blocks to hold them in engagement.
Figure 10:
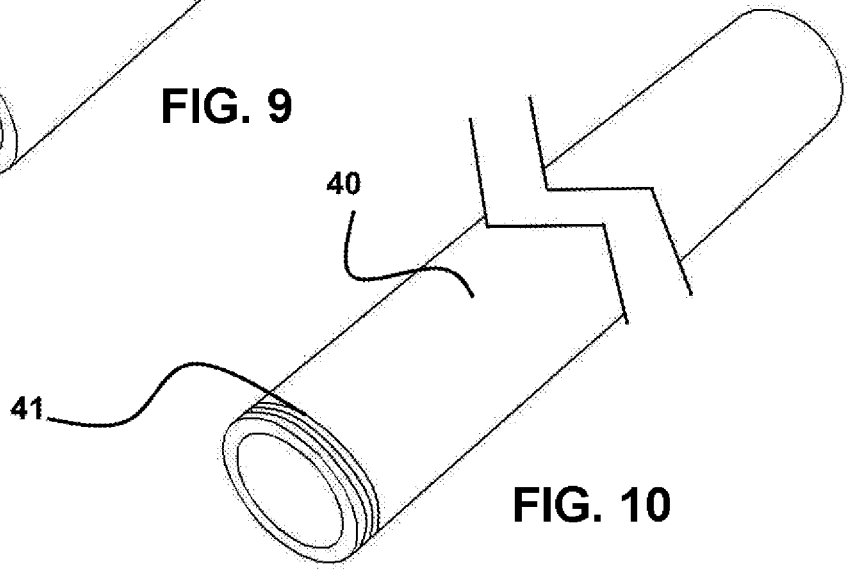
Figure 11:
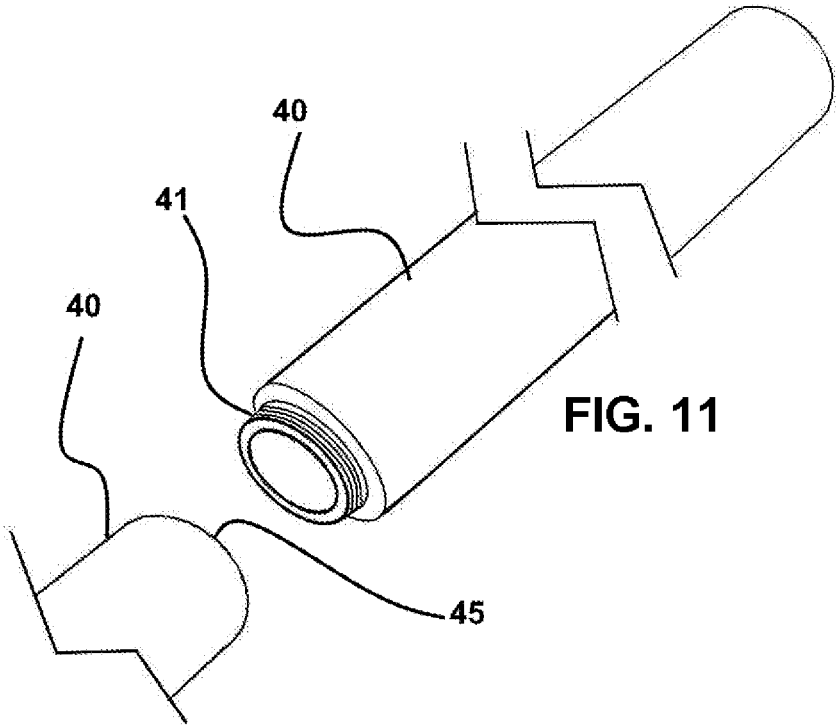

In FIGS. 9-11 are shown various configurations of support rods 40 which may be employed with the system herein. The support rods 40 may be cooperatively threaded on opposing ends which are adapted to engage with either threaded connectors 30, nuts 31, or threaded recesses 45 of additional support rods 40 so as to elongated them. The depicted configurations of the support rods 40 are not exclusive and such may be configured as would occur to those skilled in the art. Also, while the removable connection between support rods 40 is noted as threaded, it can also be other removable engagements between a distal end of one support rod 40 and that of another support rod 40, such as a bayonet mount, or other engagement as would occur to those skilled in the art.

In FIGS. 12-13 are depicted examples of the blocks 10 herein stacked adjacently in sequential rows, to form wall-like structures. As shown for convenience in a transparent rendering, the blocks 10 are positioned with their respective passages 26 aligned, and with respective support rods 40 operatively engaged within the passages 26. Appropriate connectors 30 or connector brackets engage with the support rods 40 to hold the blocks 10 stacked and in position. For example, the support rods 40, are shown in engagements in FIGS. 15-19 where the connector bracket 33 is L-shaped and dimensioned for a recessed positioning within an upper notch 12 on a top surface 14 or lower notch 13 on a bottom surface 16, and an adjacent intersecting secondary notch 18 forming a second recess in the first side 20 of the block 10. The connector brackets 33 fit entirely in the respective upper notch 12 or lower notch 13 to maintain flush or level surfaces for stacking the blocks 10 on each other.

In FIG. 14 is shown an example of the positioning of an overhead block 10 upon an underlying block 10 to form a stacked configuration. Also shown are the L-shaped connector brackets 33 engaged with the support rods 40 projecting into the bottom of the formed wall, and an elongated support rod 40 as in FIG. 15, wherein a tapered portion thereof projects above the top surface 14 of the lower positioned block 10 for positioning of the passages 26 of the upper positioned block 10 thereon.

Shown in FIG. 15, is an example of an elongated version of the support rod 40 which can be positioned as in FIG. 14 to locate a secondary tapered portion thereof, projecting above the top surface 14 of a lower positioned block 10. As noted another block 10 is easily positioned on the lower block 10 by sliding the passages 26 over the projecting secondary tapered portions of the support rods 40.

Shown in FIGS. 16 and 17, is a connector bracket 33 herein where the support rod 40 is engaged to the connector bracket 33 which is L-shaped. The support rod in FIG. 17 is rotatable in the engagement with the connector bracket 33.

Figure 18:
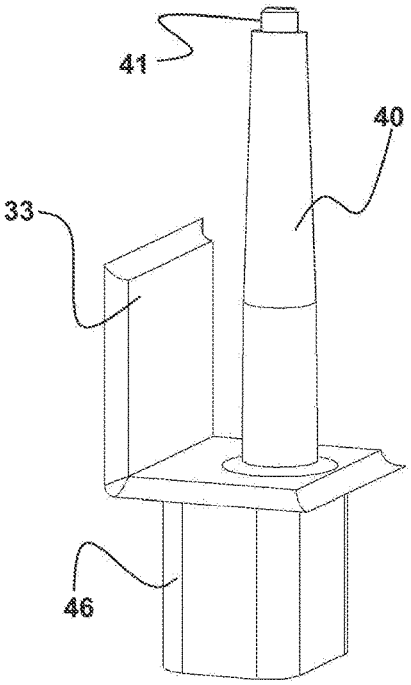
FIGS. 18-19 depict another configuration for the connector bracket which has an L-shaped connector engaged to the support rod and also has a projecting base.
Figure 19:
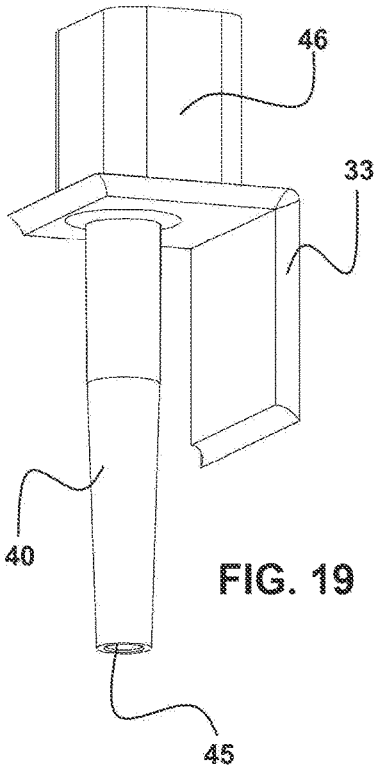

In FIGS. 18-19 are shown modes of the connector bracket 33 wherein the connector bracket 33 is L-shaped, and on an opposite side of the connector bracket 33 from that of the support rod 40, is positioned a mount 46 which can be buried in the ground or in a cement layer, to hold the connector bracket 33 in place.

Figure 20:
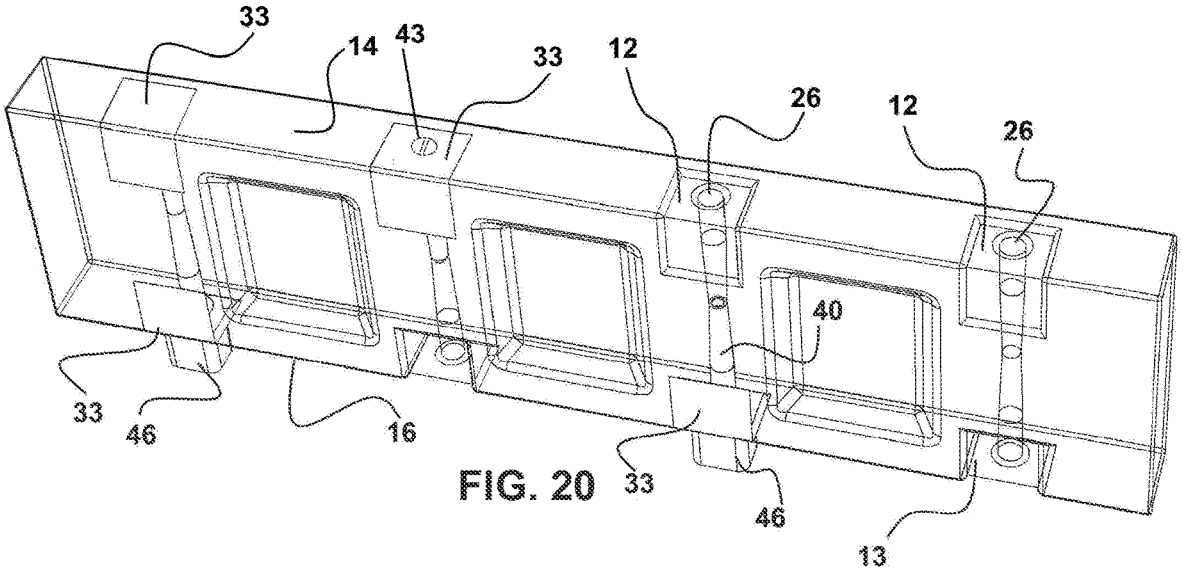
FIG. 20 shows a row of blocks in a transparent rendering showing different connector brackets engaged on opposite sides of the blocks.
Figure 26:
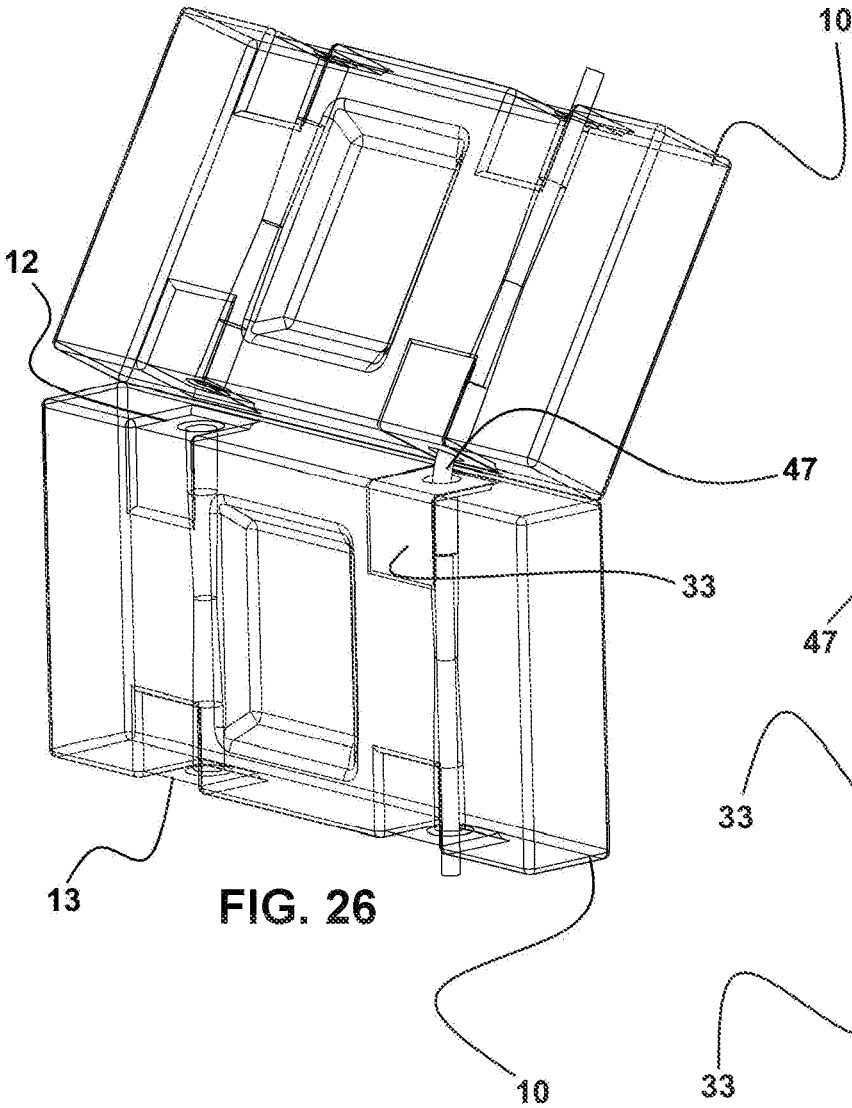
FIG. 26 shows an example of a wall formed by blocks at an angle to each other and held in that position by an angled support rod shown in FIG. 27.
Figure 27:
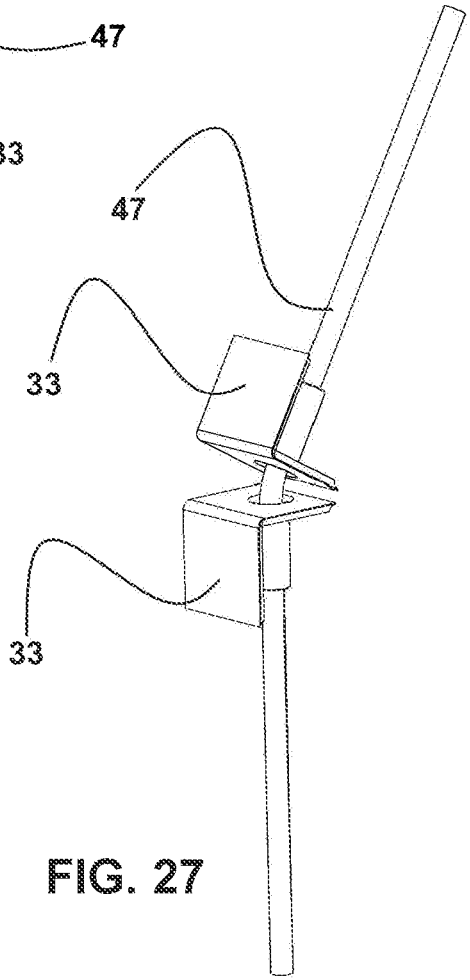
FIG. 27 shows a curved mode of the support rod 47 engaged with connector brackets, which can be employed to form the angled wall of FIG. 26.

In FIG. 20 is shown various connector brackets 33 in operative connections through the bottom and top surfaces of a wall formed of adjacently stacked blocks 10. As shown, the connector brackets 33 of FIGS. 16-17 are used for a base, and a connector bracket 33 as in FIGS. 16 and 17 are engaged on the top of the wall. While shown as a single block row in a layer, the connector brackets on the top would be used in the same fashion where a second or third row of blocks 10 are stacked. Because all of the connector brackets 33 are sized to fit completely in a respective upper notch 12 or lower notch 13 when engaged with a support rod 40, the top surface of each row remains flush, for the level stacking of the next row thereon to form the wall.

FIGS. 21-23 depict side brackets 48 inner and outer corner brackets 50 of the system herein which are engageable to the blocks 10 with projecting tabs 52 adapted for recessed positioning within the upper notches 12. Examples of positioning of the corner brackets 50 and side brackets 48 are shown in FIGS. 24 and 25. Tab openings 54 allow for passage of the support rods 40 therethrough.

It should be noted that any of the different depicted and described configurations and components of the block and structures formed thereby, can be employed with any other configuration or component shown and described as part of the block device and building system herein. Additionally, while the present invention has been described herein with reference to particular embodiments thereof and/or steps in the method of production or use, a latitude of modifications, various changes and substitutions are intended in the foregoing disclosure, and it will be appreciated that in some instance some features, or configurations, of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

What is claimed is:

1. A mortarless block system comprising:

a block, said block having a top surface and a bottom surface opposite said top surface;

said block having a first side communicating between said top surface and said bottom surface and having a second side opposite said first side;

said block having a first endwall opposite a second endwall;

a first plurality of upper notches forming recessed areas in said top surface of said block;

a second plurality of lower notches each forming recessed areas into said bottom surface;

each of said upper notches being aligned with a respective one of said lower notches to form aligned pairs of notches;

passages running through said block between each of said aligned pairs of notches;

a plurality of said blocks positionable in stacked rows of said blocks in adjacent positions to each other to form a wall;

a connector bracket for holding an upper row of said blocks in said stacked rows positioned atop a lower row of said blocks in said stacked rows;

a support rod running through said passages of said blocks in said upper row and said passages of said blocks in said lower row;

a first end of said support rod having a first said connector bracket engaged thereto, said first connector bracket dimensioned to fit within said upper notch on a said block in said upper row; and a second end of said support rod engaged with a second said connector bracket, said second connector bracket dimensioned to fit within said lower notch of a block in said lower row.

2. The mortarless block system of claim 1, additionally comprising:

said support rod having a first section extending from said first end thereof to a first distal end;

said support rod having a second section extending from said second end thereof, to a second distal end; and said first section of said support rod being engageable to said second section of said support rod by a connector at said first distal end which is engageable with a mating connector positioned at said second distal end.

3. The mortarless block system of claim 2, additionally comprising:

a respective secondary recess formed into said first side of said block adjacent each of said first plurality of upper notches and each of said second plurality of lower notches.

4. The mortarless block system of claim 1, additionally comprising:

a respective secondary recess formed into said first side of said block adjacent each of said first plurality of upper notches and each of said second plurality of lower notches.

5. The mortarless block system of claim 1, additionally comprising:

said first end of said support rod being in a rotational engagement with said first connector bracket.

6. The mortarless block system of claim 1, additionally comprising:

corner brackets for securing corner intersections of said blocks forming said wall;

said corner brackets having tabs projecting therefrom having tab openings therein; and said tab openings dimensioned to fit entirely within said upper notches of abutting said blocks at a said corner intersection.

7. A mortarless block system comprising:

a block, said block having a top surface and a bottom surface opposite said top surface;

said block having a first side communicating between said top surface and said bottom surface and having a second side opposite said first side;

said block having a first endwall opposite a second endwall;

a first plurality of upper notches forming recessed areas in said top surface of said block;

a second plurality of lower notches each forming recessed areas into said bottom surface;

each of said upper notches being aligned with a respective one of said lower notches to form aligned pairs of notches;

passages running through said block between each of said aligned pairs of notches;

a plurality of said blocks positionable in stacked rows of said blocks in adjacent positions to each other to form a wall;

said block having a hollow interior cavity by an area surrounded by said top surface, said bottom surface, said first side, said second side, said first endwall and said second endwall;

said block having a fill opening communicating with said interior cavity for deposit of fill material therein; and a connector bracket for holding an upper row of said blocks in said stacked row positioned atop a lower row of said blocks in said stacked row, wherein upper ends of said passages running through each said block in said upper row, are aligned with lower ends of said passages in each said block in said lower row;

a support rod running through both said passages running through said blocks in said upper row and said passages in said blocks in said lower row, a first end of said support rod having a first said connector bracket engaged thereto, said first connector bracket dimensioned to fit within a said upper notch on a said block in said upper row; and a second end of said support rod engaged with a second said connector bracket, said second connector bracket dimensioned to fit within a said lower notch of a block in said lower row.

8. The mortarless block system of claim 7, additionally comprising:

a respective secondary recess formed into said first side of said block adjacent each of said first plurality of upper notches and each of said second plurality of lower notches.

9. The mortarless block system of claim 7, additionally comprising:

said first end of said support rod being in a rotational engagement with said first connector bracket.

* * * * *